United States Patent [19]
Gore et al.
[11] 4,147,108
[45] Apr. 3, 1979

[54] WARHEAD

[75] Inventors: Bertram W. Gore, Owings Mills; Nicholas J. LaCosta; Irwin R. Barr, both of Kingsville, all of Md.

[73] Assignee: AAI Corporation, Cockeysville, Md.

[21] Appl. No.: 495,252

[22] Filed: Mar. 17, 1955

[51] Int. Cl.² ..... F42B 13/48
[52] U.S. Cl. ..... 102/67; 102/DIG. 7
[58] Field of Search ..... 102/67, 59, 21.6, 5, 102/7.2, DIG. 7

[56] References Cited

U.S. PATENT DOCUMENTS

| | | | |
|---|---|---|---|
| 2,337,765 | 12/1943 | Nahirney | 102/67 |
| 2,373,883 | 4/1945 | Ferrel | 102/56 |
| 2,434,452 | 1/1948 | Barber | 102/67 |

FOREIGN PATENT DOCUMENTS

| | | | |
|---|---|---|---|
| 684953 | 7/1930 | France | 102/67 |

*Primary Examiner*—Verlin R. Pendegrass
*Attorney, Agent, or Firm*—Reginald F. Pippin, Jr.

EXEMPLARY CLAIM

1. An explosive device comprising an explosive charge, a casing enclosing said charge, said casing being formed of rubber, a plurality of projectiles arranged around the exterior of said casing in juxtaposition therewith, means for detonating said explosive charge, and container means enclosing said projectiles and said explosive charge.

9 Claims, 2 Drawing Figures

BERTRAM W GORE
IRWIN R. BARR
NICHOLAS J. LA COSTA
*INVENTORS*

BY Thomas J. Holden
ATTORNEY

WARHEAD

This invention relates to explosive devices used as weapons, and more specifically to an explosive device for propelling a large number of projectiles simultaneously in a radial pattern and particularly suited to use in a projectile.

While artillery shells and missiles of various types are generally provided with an explosive charge encased in a frangible enclosure which is designed to shatter into fragments upon detonation of the charge, much of the effectiveness of the fragments is lost because air resistance rapidly reduces the velocity of the irregularly shaped fragments, and the spinning motion produced by the explosion affects the paths of the fragments, making the expected pattern erratic and reducing the effectiveness of the projectile. The arrangement contemplated by this invention provides a warhead which will propel an extremely large number of aerodynamically stable projectiles in a unform pattern and at a controlled velocity.

The chief difficulties in providing such a warhead have been encountered in providing a simple means to impart substantially equal velocity to each of a large number of closely packed projectiles and to provide effective stabilizing means for each projectile which will not be damaged by the explosion of the propellant. These difficulties have been overcome in the contemplated arrangement by providing a resilient blanket between the propellant and the projectiles to accelerate the projectiles uniformly upon explosion of the propellant, and by arranging the projectiles in a manner to prevent damage to the stabilizing means as will be more fully described hereinafter in the specification.

It is the object of this invention, therefore, to provide an explosive device which will, upon detonation, propel a large number of aerodynamically stable projectiles at a substantially uniform velocity and in a predetermined pattern.

It is another object of this invention to provide an explosive device which will, upon detonation, dispense a large number of fin stabilized projectiles at a high velocity without damaging the projectile fins.

Figure 2:
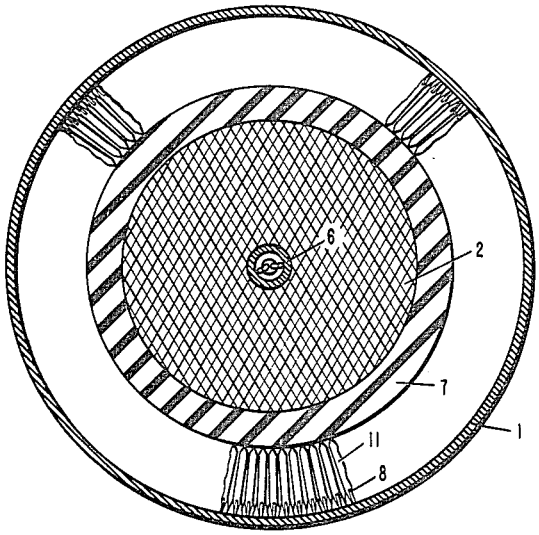
FIG. 2 is a cross-section taken along line 2—2 of FIG. 1.
Figure 1:
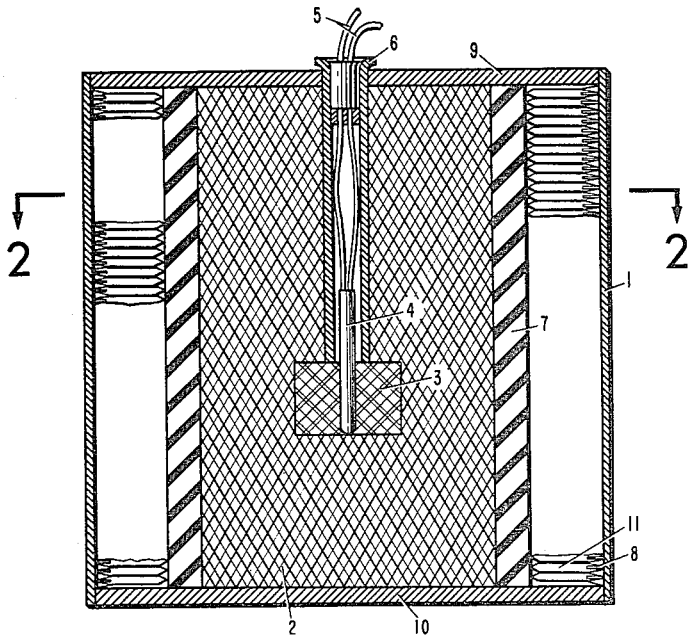
FIG. 1 is a sectional view showing a warhead constructed in accordance with this invention.

As may be seen in FIG. 1, the proposed arrangement comprises a plastic shell 1 which contains a propelling charge 2 composed of any suitable explosive. A suitable detonator is embedded in the charge 2, the arrangement shown consisting of a booster pellet 3 and an initiator 4 which is connected to a source of electric power through wires 5 extending through a plastic tube 6. A large number of individual projectiles 11 are arranged radially around the charge 2. Each projectile is provided with fins 8 to stabilize it in flight. A rubber cushion 7 is interposed between the charge 2 and to the projectiles 11 and surrounds the charge. Plates 9 and 10 enclosed the top and bottom respectively of the shell 1.

When the propelling charge 2 is detonated, the cushion 7 is suddenly expanded by the gases resulting from the explosion and accelerates the projectiles in a direction radially outward from the charge. Because of the resilience of the cushion, it can expand uniformly in a radial direction before rupturing, thus accelerating the projectiles to a high velocity. The cushion 7 also acts as a buffer, absorbing a portion of the shock of the explosion to prevent damage to the projectiles. In this manner, an extremely high velocity can be imparted to the projectiles without damaging them or distorting their aerodynamic configuration.

An additional and important feature of the invention lies in the arrangement of the projectiles around the charge 2 with the fins 8 outward. Much of the difficulty in providing an explosive device for projecting a plurality of aerodynamically stable projectiles results from the damage sustained by the fins of such projectiles upon detonation of the propelling charge. By arranging the projectiles 11 in the manner depicted and utilizing the resilient cushion 7 to accelerate the projectiles, high projectile velocities can be obtained without damage to the stabilizing fins. This, in turn, results in a uniform pattern of projectile distribution and prevents loss of effectiveness due to bunching of the projectiles or erratic flight due to fin damage.

The device contemplated is not limited to the configuration shown in the drawing, but may be made in any suitable shape for obtaining the desired projectile distribution upon detonation of the charge, a sperical shape being obviously another desirable configuration.

The invention described provides a simple and highly effective device for distributing a group of projectiles in the most effective pattern at a uniform high velocity, and provides means for utilizing an explosive charge to scatter aerodynamically stable projectiles without damaging the projectiles or their stabilizing fins. Such a device is adaptable for use in conventional artillery projectiles and is especially suited for incorporation as a warhead in various types of missiles.

While but one embodiment of the present invention has been shown and described, it is apparent that many changes and modifications can be made without departing from the spirit of the invention or the scope of the claims.

We claim:

1. An explosive device comprising an explosive charge, a casing enclosing said charge, said casing being formed of rubber, a plurality of projectiles arranged arroung the exterior of said casing in juxtaposition therewith, means for detonating said explosive charge, and container means enclosing said projectiles and said explosive charge.

2. An explosive device comprising an explosive charge, a casing enclosing said charge, said casing being formed of rubber, a plurality of projectiles arranged around the exterior of said casing and having their forward ends in juxtaposition therewith, initiator means for detonating said explosive charge, and means forming a container enclosing said projectiles and said explosive charge.

3. An explosive device comprising an explosive charge, an initiator for detonating said charge, a casing enclosing said explosive charge, said casing being formed of rubber a plurality of finned projectiles arranged around said casing with the forward ends of said projectiles in juxtaposition with said casing, and a container enclosing said projectiles and said charge.

4. An explosive device comprising an explosive charge, an initiator for detonating said charge, a rubber casing enclosing said charge, a plastic container enclosing said rubber casing and forming an annular chamber between said container and said casing, a plurality of fin stabilized projectiles contained within said chamber and arranged with the forward ends of said projectiles adjacent said rubber casing.

5. A warhead for a missle comprising a cylindrically shaped explosive charge, an initiator for detonating said charge, a tubular rubber casing enclosing said charge, a plastic container enclosing said rubber casing and forming an annular chamber between said container and said casing, a plurality of fin stabilized projectiles contained within said annular chamber and arranged in a radial pattern with the forward ends of said projectiles directed inwardly and abutting said rubber casing, and metallic plates enclosing the end of said plastic container.

6. An explosive device comprising an explosive charge, means for detonating said charge, a layer of resilient material enclosing said charge, said material being rubber and a plurality of projectiles arranged externally of said resilient material, so that expansion of said resilient material due to detonation of said charge will propel said projectiles outward from said charge.

7. An explosive device comprising an explosive charge, means for detonating said charge, a layer of resilient material enclosing said charge, said material being rubber and a plurality of finned projectiles arranged externally of said resilient material with the forward ends of said projectiles in contact with said resilient material, whereby said projectiles will be propelled outwardly upon detonation of said charge.

8. An explosive device comprising an explosive charge, means for detonating said charge, a layer of resilient material enclosing said charge, said material being rubber a plurality of projectiles arranged externally of said resilient material, and a frangible container enclosing the whole.

9. An explosive device comprising an explosive charge, means for detonating said charge, a layer of resilient material enclosing said charge, said material being rubber a plurality of finned projectiles arranged externally of said resilient material with the axes of said projectiles normal to said resilient material, and a frangible container enclosing the whole.

* * * * *